US005868005A

United States Patent [19]

Larue et al.

[11] Patent Number: 5,868,005

[45] Date of Patent: Feb. 9, 1999

[54] PROCESS FOR DEHYDRATING AND DEGASSING A GAS, COMPRISING TWO COMPLEMENTARY SOLVENT REGENERATION STEPS

[75] Inventors: Joseph Larue, Rueil Malmaison; Nicole Doerler, Nanterre; Etienne Lebas; Alexandre Rojey, both of Rueil Malmaison, all of France

[73] Assignee: Institut Francais du Petrole, France

[21] Appl. No.: 936,097

[22] Filed: Sep. 23, 1997

[30] Foreign Application Priority Data

Sep. 24, 1996 [FR] France ..... 96/11694

[51] Int. Cl.[6] ..... F25J 1/00

[52] U.S. Cl. ..... 62/625; 62/633

[58] Field of Search ..... 62/625, 633

[56] References Cited

U.S. PATENT DOCUMENTS

| | | | |
|---|---|---|---|
| 2,672,034 | 3/1954 | Morrow | 62/633 |
| 2,994,644 | 8/1961 | Clay | 62/633 |
| 3,925,047 | 12/1975 | Harper | 62/633 |
| 4,266,958 | 5/1981 | Cummings | 62/633 |

FOREIGN PATENT DOCUMENTS

| | | |
|---|---|---|
| 2 605 241 | 4/1988 | France . |
| 2 636 857 | 3/1990 | France . |

*Primary Examiner*—Ronald Capossela
*Attorney, Agent, or Firm*—Millen, White, Zelano, & Branigan, P.C.

[57] ABSTRACT

A process for treating a gas containing methane, at least one higher hydrocarbon and water to eliminate the water and extract the higher hydrocarbon(s) comprises:

a) separating the gas to be treated into two streams (1) and (2);

b) bringing at least stream (2) into contact with a recycled liquid phase comprising water and a solvent, to obtain an aqueous liquid phase which is depleted in solvent and a gas phase which is charged with solvent;

c) separating the aqueous phase which is depleted in solvent and the gas phase which is charged with solvent;

d) bringing said aqueous phase which is depleted in solvent into contact with one of the solvent-free gas streams defined at (a), the solvent being extracted from the depleted aqueous phase by the gas, and recovering a gas phase which is rich in solvent and a regenerated aqueous liquid phase;

e) mixing the gas phase with either the gas phase from step (b) or the stream (2) upstream of contact step (b);

f) cooling the gas phase from the mixing step so as to partially condense it into an aqueous phase containing solvent and a hydrocarbon phase and to produce the treated gas, free of at least part of the water and the higher hydrocarbons it contains;

g) separating said aqueous phase and hydrocarbon phase from step (f) by settling; and h) recycling said aqueous phase containing solvent to step (b).

18 Claims, 2 Drawing Sheets

PROCESS FOR DEHYDRATING AND DEGASSING A GAS, COMPRISING TWO COMPLEMENTARY SOLVENT REGENERATION STEPS

The invention concerns a process for treating a gas containing methane. at least one higher hydrocarbon and water, to eliminate the water and/or extract the higher hydrocarbon(s) therefrom.

The process of the invention can advantageously be used to carry out natural gas treatment operations, namely dehydration and separation of at least part of the condensable hydrocarbons included in the natural gas, using an integrated and optimized process.

Petroleum products, in particular natural gas, and other gases containing hydrocarbons such as refinery gas, contain substances which are undesirable as regards transport and/or handling.

One of the principal constituents to be eliminated from such substances is water, which has been shown to be a hydrate promoter and encourages corrosion, in particular when the petroleum product contains acidic compounds such as $H_2$ S and/or $CO_2$. Hydrates can cause blockages in the transport lines and the corrosive action of the acidic gases contained in a natural gas causes deterioration of the downstream lines and facilities for treating and distributing natural gas.

These two phenomena have extremely bad consequences which can lead to a stoppage in hydrocarbon production.

Gas treatment can also include a step for extracting higher hydrocarbons, for example a liquid natural gas fraction (LNG) defined as comprising an LPG fraction and a gasoline fraction ($C_5^+$). Such a step either adjusts the hydrocarbon dew point to avoid condensation of a hydrocarbon fraction during gas transport, or recovers an LNG fraction, which has a higher market value than the treated gas.

The prior art describes different processes for treating natural gas.

French patent FR-B-2 605 241 describes a treatment process using a cooled physical solvent to carry out all of the natural gas treatment operations: dehydration, alone or combined with extraction of higher hydrocarbons, and/or deacidification of that gas, if it contains acidic compounds.

FR-B-2 636 857 shows that when the process comprises a step for separating the higher hydrocarbons (LNG), solvent recovery can be improved by using a step for washing the liquid hydrocarbons with water from the gas dehydration step.

The applications of such a process have been discussed, for example, in the publication "IFPEXOL for Environmentally Sound Gas Processing" by J. Larue, A. Minkkinen and S. Patel, presented at the 71$^{st}$ "GPA" convention in March 1992 at Anaheim, Calif, USA.

The publication "Integrated Natural Gas Treatment: Gained Industrial Experience with IFPEXOL Process" by S. Patel, A. Minkkinen, J. Larue and J. F. Levier, presented at "IGCR 95", Cannes, France in November 1995, describes washing the liquid hydrocarbon phase with water to recover at least part of the solvent it contains.

FIG. 1 shows a prior art process when the gas to be treated contains methane, water, at least one condensable hydrocarbon, and possibly acidic compounds. The process can be described as follows.

Natural gas to be treated arrives via a line 1. All or a fraction of the gas is brought into contact with a mixture of solvent and water from line 2, in a contact zone G1 formed by a packing, for example.

The solvent used can be selected from methanol, ethanol, propanol, methylpropylether, ethylpropylether, dipropylether, methyltertiobutylether, dimethoxymethane, dimethoxyethane and methoxyethanol. Methanol is the preferred solvent.

A gas phase charged with solvent is evacuated overhead via a line 3. An aqueous phase which is substantially free of solvent is extracted from the bottom via a line 4.

It should be noted that the treatment process can be optimized by adjusting the gas fraction passing through contact zone G1 and the gas fraction which circulates outside this contact zone as a function of the composition of the gas to be treated and the performances required. This option, shown in FIG. 1 as a dotted line, allows a portion of the gas to be treated, circulating via a line 18, to be directly mixed with the gas leaving the contact zone via line 3. The fraction of gas which does not enter the contact zone can, for example, comprise between 0 and 50% of the quantity of gas to be treated.

The overhead gas phase, containing water and solvent, is usually close to saturation. It is cooled by a coolant in an exchanger E1 to condense an aqueous phase containing solvent and a liquid hydrocarbon phase. It has been shown that the solvent entrained in the gas phase at the outlet from contact zone G1 may be sufficient to avoid the problems of hydrate formation connected with the cooling step E1. A makeup can be added to the process via a line 5 to compensate for loss of solvent in the treated gas, in the liquid hydrocarbon fraction (LNG) and possibly in the water discharged via a line 19. A purge stream can be established via line 19 to keep constant the quantities of solvent and water present in the total circuit.

The mixture of gas and liquid phases obtained leaves exchanger E1 via a line 6. The two liquid phases and the gas phase are separated in a drum B1.

The treated dehydrated gas is evacuated from this drum via a line 7. The two liquid phases from the condensation step are separated by setting in the lower portion of B1.

The aqueous phase, formed essentially of water and solvent, leaves drum B1 via a line 8. A pump P1 reinjects the aqueous phase via a line 9 into line 2 and then into contact zone G1.

The hydrocarbon phase, formed essentially of condensable hydrocarbons of natural gas ($C_3^+$) (possibly containing dissolved ethane and methane) and solvent, can be evacuated to a stabilisation and washing circuit via a line 10. At this stage of the process, heat exchange between the gas from contact zone G1 and the hydrocarbon phase evacuated from line 10 is possible. It is not shown in FIG. 1. A pump P2 sends the liquid hydrocarbon phase to a stabilisation column S1 via a line 11. The aim of this operation is to separate the most volatile components ($C_1$ and $C_2$) from the liquid hydrocarbon phase and evacuate them from the process via a line 12. The hydrocarbon phase containing constituents with a molar mass of over $C_2$ is sent via a line 13 to a water washing zone G2 to eliminate the solvent it contains.

The aqueous phase, evacuated from contact zone G1 via line 4 and at least partially free of solvent, is taken up by a pump P3. A fraction of this aqueous phase is sent to contact zone G2 via a line 14, at a controlled flow rate. The other fraction is evacuated via line 19.

In contact zone G2, the fraction of the aqueous phase arriving via line 14 washes the hydrocarbon phase. The solvent has a higher affinity for water than for the hydrocarbon phase and is at least partially recovered in the aqueous phase at the outlet from this step.

The liquid hydrocarbon phase, free of the major portion of the solvent it contained on entering contact zone G2, is evacuated via line 15.

The aqueous phase containing the solvent is evacuated from contact zone G2 via a line 16. This phase is taken up by a pump P4 and injected into contact zone G1. Depending on the concentration of the solvent, this phase is injected into contact zone G1 via a line 17 or it is injected into line 2 to be mixed with the aqueous phase arriving from drum B1 via line 9.

This process has important advantages over previous techniques. It means a significant gain as regards investment and the floor space and weight of facilities, which can be of particular advantage when considering offshore hydrocarbon production. Further, separating water and solvent by contact with the gas to be treated can avoid the need for separation by distillation.

However, it is also possible to make additional gains as regards investment, floor space and weight and as regards the operating costs of gas treatment by using the process of the invention.

The process and facility of the invention are advantageously used to dehydrate a gas such as natural gas containing water and at least one higher hydrocarbon, and to produce at least partial separation of the condensable hydrocarbons.

In general, the process of the invention can be defined as comprising the following steps:

a) separating the gas to be treated into two streams (1) and (2). The fraction of gas present in stream (2) can represent 25% to 95% of the gas to be treated; it preferably represents 30% to 50% of the total gas;

b) bringing at least stream (2) into contact with a recycled liquid phase comprising both water and a solvent generally consisting of a non hydrocarbon organic compound, normally a liquid, other than water, at least partially miscible with water and distillable at a temperature which is lower than the distillation temperature of water. During this step, the solvent preferably passes into the gas. At the outlet to this contact zone, an aqueous liquid phase is obtained which is depleted in solvent when compared to the recycled liquid phase, also a gas phase which is charged with solvent;

c) separating the aqueous phase which is depleted in solvent and the gas phase which is charged with solvent;

d) bringing the aqueous phase which is depleted in solvent into contact with stream (1) of the gas to be treated, which is free of solvent, in a contact zone, to extract the residual solvent from the depleted aqueous phase by the gas, and obtaining a gas phase which is rich in solvent and a regenerated aqueous liquid phase from this step;

e) mixing the solvent-rich gas phase from step (d) either with the gas phase charged with solvent from step (b) or with the gas stream (2) which is free of solvent, upstream of contact step (b);

f) cooling the gas phase from the mixing step so as to partially condense it into an aqueous phase and a hydrocarbon phase, both containing solvent, and to produce the treated gas, free of at least part of the water and the higher hydrocarbons it contained;

g) separating the aqueous phase and the hydrocarbon phase from step (f) by decanting; and h) recycling the aqueous phase which is rich in solvent to step (b) of the process.

If necessary, the liquid hydrocarbon phase can be stabilised and/or freed of the solvent it contains. This is effected by sending the liquid hydrocarbon phase to a stabilisation column. During the stabilisation step, the most volatile compounds in the liquid hydrocarbon phase ($C_1$ and $C_2$) are evacuated from the process. The hydrocarbon phase containing compounds higher than $C_2$ is subsequently brought into contact with an aqueous phase which is free of solvent, which can be all or part of the water from step (d). Following contact, which can, for example, be carried out in a static mixer, the hydrocarbon phase which is free of solvent and the aqueous phase which is charged with solvent are separated. The hydrocarbon phase is extracted. The aqueous phase charged with solvent is recycled to step (b) and/or step (d).

The advantages and characteristics of the invention will become more clear from the descriptions of non limiting examples and applications of the treatment of natural gas, made with reference to the accompanying drawings.

FIG. 2 shows one implementation of the process of the invention.

Figure 1:
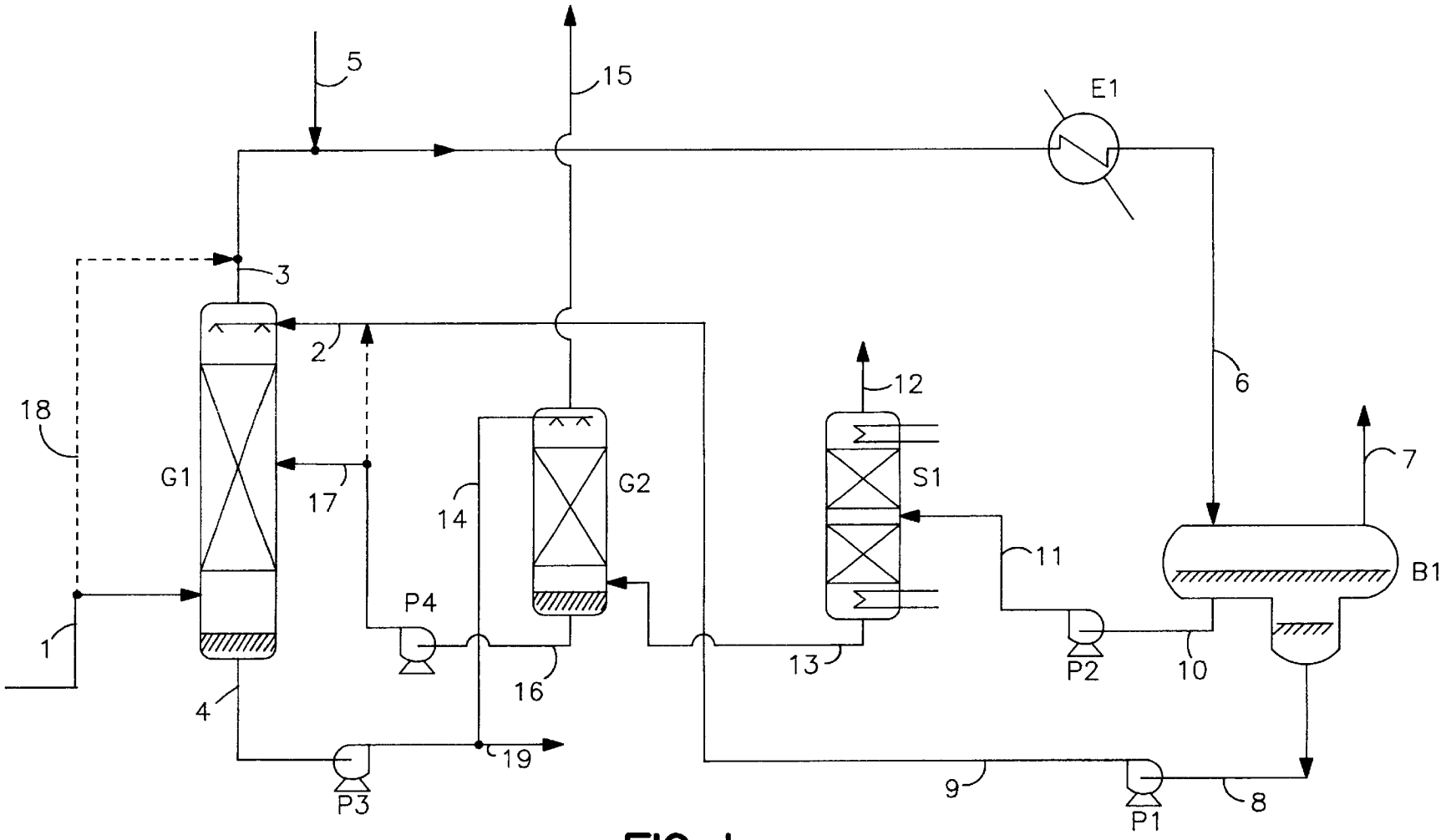

The aqueous phase charged with solvent from separating drum B1 is sent via line 8 and pump P1 to line 9 and a mixer M21, which latter is also connected to by-pass gas supplied via line 18. During the mixing step, the gas becomes charged with solvent. The two aqueous and gaseous phases are separated in a separator drum B21.

The gas charged with solvent leaving drum B21 via a line 21 is mixed with gas leaving contact zone G1, then sent via line 3 to exchanger E1.

The aqueous phase from drum B21 is relieved of a portion of the solvent which it contained at the outlet from drum B1. It is injected to the head of contact zone G1 via a line 22. The concentration of solvent in the aqueous phase circulating via line 22 is much lower than that of the solution circulating in line 9. Because of this low concentration, the cross section and/or height of the contact zone G1 will be substantially reduced with respect to those required in the prior art process. If the process contains a step for washing higher hydrocarbons, the aqueous phase leaving the washing step via line 17 can optionally be injected into contact zone G1 or mixed with the aqueous phase in line 22. The choice of injection point for the aqueous phase is made depending on its solvent content.

Since a smaller quantity of solvent passes from the aqueous phase to the gaseous phase during the contact step in zone G1, the size of the equipment used for this contact step is significantly reduced.

A further implementation of the process of the invention will now be described with reference to FIG. 3.

In this implementation, all of the gas produced, in lines 3 and 18. is sent to a mixer M22. All of the gas is mixed in mixer M22 with the aqueous solution which is charged with solvent from drum B1 circulating via line 9. The gas leaving a separation drum B22 via a line 23 is sent directly to exchanger E1 while the aqueous phase leaving drum B22 via a line 24 is injected into contact zone G1. As described above, if the process contains a step for washing higher hydrocarbons, the aqueous phase leaving the washing step via line 17 can optionally be injected into contact zone G1 or mixed with the aqueous phase in line 24.

The solvent used in the process of the invention can be selected from methanol, ethanol, propanol, methylpropylether, ethylpropylether, dipropylether, methyltertiobutylether, dimethoxymethane, dimethoxyethane and methoxyethanol. Methanol is normally used.

Example 1 below illustrates a prior art process and Examples 2 and 3 illustrate two particular implementations of the process of the invention.

EXAMPLE 1

In this example, the prior art process represented by FIG. 1 was used. A natural gas was produced on site at a pressure of 6 MPa and at a temperature of 50° C.; its composition is given in Table 1. It was saturated with water (water content at the process inlet of about 6000 ppm mole). The flow rate was 108 tonnes/h, corresponding to an output of 3.0 $MNm^3$/day.

| Composition | % by weight |
|---|---|
| $N_2$ | 1.6 |
| $CO_2$ | 3.4 |
| Methane | 70.4 |
| Ethane | 11.6 |
| Propane | 6.9 |
| Butane | 3.7 |
| Pentane | 1.4 |
| $C_{6+}$ | 1.0 |

The solvent used in this application was methanol.

Half of the gas produced (50%) was injected into contact zone G1 via line 1. The other half (50%) was directed to the head of the contactor via line 18. Contactor G1 contained a structured packing. An aqueous solution of recycled methanol was injected into the head of the contactor via line 2 at a temperature of −25° C. After the contact step, an aqueous solution which was depleted in solvent left the contactor via line 4. This solution contained 160 ppm by weight of methanol. Its flow rate was 245 kg/h; it approximately corresponded to the quantity of water initially contained in the 108 tonnes/h of gas to be treated.

The gas containing methanol was directed to exchanger E1 via line 3. It received a makeup of 40 kg/h of methanol via line 5. After exchanger E1, its temperature was −25° C. Drum B1 separated:

- a stream of 99500 kg/h of treated gas containing a residual quantity of 14 ppm mole of water, i.e., 10.5 $kg/MNm^{3;}$
- a stream of 616 kg/h of water charged with methanol, which was recycled to contact zone G1; and
- a stream of 8400 kg/h of a condensed hydrocarbon phase (LNG) which could optionally be stabilised. then washed to free it of the solvent it contained, before upgrading.

EXAMPLE 2

Figure 2:
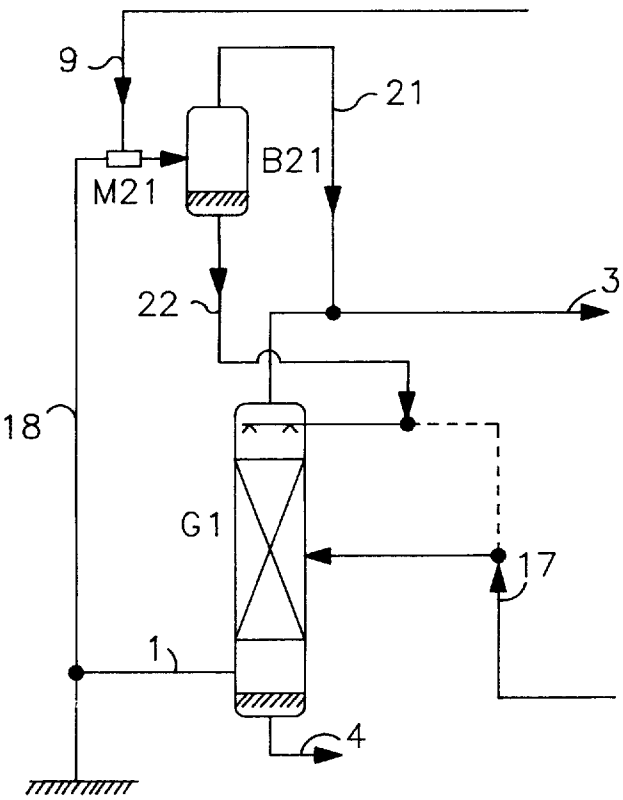

In this example natural gas produced on site under the pressure, temperature, flow rate and composition conditions described in Example 1 was treated using the process of the invention described in FIG. 2. In this example, the solvent used was again methanol.

In this example, the by-pass gas from line 18 was brought into contact in mixer M21 with the aqueous phase charged with solvent from separator drum B1 via line 8. During this mixing step, the gas became charged with solvent.

The two aqueous and gaseous phases were separated in a separator drum B21.

The gas charged with solvent leaving drum B21 via line 21 was mixed with gas leaving contact zone G1 then sent via line 3 to exchanger E1.

The aqueous phase leaving drum B21 had been relieved of a portion of the solvent it contained at the outlet from drum B1. It was injected via line 22 to the head of contact zone G1.

By means of the first contact step between the gas and the solution which was rich in solvent in mixer M21, the concentration of solvent in the aqueous solution is divided by a factor of 2.5 with respect to the solution circulating in line With all other things being equal, identical performances to those described in Example 1 were obtained using a reduced contact column G1. Contact of the aqueous solution which was partially depleted in solvent with 44% of the gas to be treated was sufficient to strip the solution.

When 56% of the gas was by-passed, the methanol concentration in the water leaving the contactor via line 4 was 160 ppm, as shown in Example 1.

The solution was stripped using a column with a diameter which was reduced by 6% with respect to the preceding example. The weight of steel linked to this reduction in diameter was proportional to that reduction.

The volume of packing required was also reduced, by 12%; however, the depth of the packing was identical to that of Example 1.

EXAMPLE 3

Figure 3:
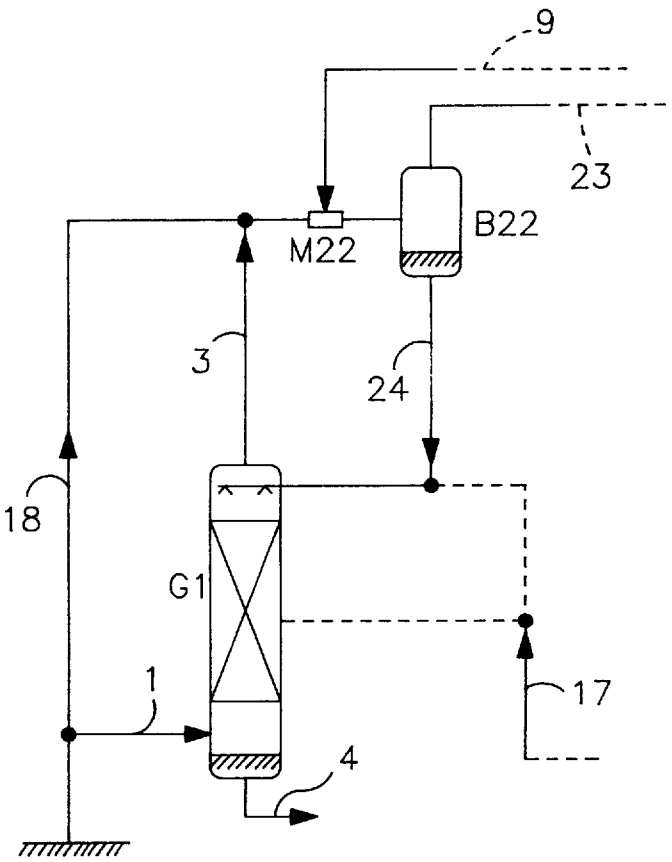
FIGS. 2 and 3 show the process of the invention, namely an improvement to the process described in the prior art, which can reduce the cross section and/or height of contact zone G1 by introducing a mixer and a separator into the unit upstream of contact zone G1 to provide a first exchange step between the aqueous solution which is charged with solvent and all or part of the gas to be treated.

In this example natural gas produced on site under the pressure, temperature, flow rate and composition conditions described in Example 1 was treated using the process of the invention described in FIG. 3. In this example, the solvent used was again methanol.

In this example, part of the gas to be treated was sent to contact zone G1 via line 1. As before, the gas charged with solvent after contact left G1 via line 3. It was mixed with solvent-free by-pass gas in line 18. The total gas was mixed in mixer M22 with recycled aqueous solution charged with solvent. The mixture was sent to separator drum B22.

Two phases left separator drum B22:

- gas containing solvent, which was sent to heat exchanger E1 via line 23; and
- the aqueous partially depleted solvent solution, which was sent to contact zone G1 via line 24.

By means of the first contact step between the gas and the solution which was rich in solvent in mixer M22, the concentration of solvent in the aqueous solution was divided by a factor of 3.5 with respect to the solution circulating in line 9.

With all other things being equal, identical performances to those described in Example 1 were obtained using a reduced contact column G1. Contact of the aqueous solution which was partially depleted in solvent with 31% of the gas to be treated was sufficient to strip the solution.

When 69% of the gas was by-passed, the methanol concentration in the water leaving the contactor via line 4 was 160 ppm, as in Example 1.

The solution was stripped using a column with a diameter which was reduced by 21% with respect to Example 1. The weight of steel linked to this reduction in diameter was proportional to that reduction.

The volume of packing required was also reduced, by 38%; however, the depth of the packing was identical to that of Example 1.

Comparison of prior art Example 1 and Examples 2 and 3 of the invention show that the process of the invention can significantly reduce the cross section of the contact zone and therefore the bulk and weight of the equipment, also the volume of packing required to treat the gas.

The process of the invention has the advantage of being cheaper than the prior art processes described, by a double reduction, in the cross section of the contactor and in the volume of packing required.

The preceding examples can be repeated with similar success by substituting the generically or specifically described reactants and/or operating conditions of this invention for those used in the preceding examples.

The entire disclosure of all applications, patents and publications, cited above and below, and of corresponding French application 96/11694, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

We claim:

1. A process for the treatment of a gas containing methane, water and at least one hydrocarbon higher than methane, said process freeing at least part of the gas of water and hydrocarbons higher than methane, and being characterized in that it comprises the following steps:

a) separating the gas to be treated into two streams (1) and (2);

b) bringing at least said stream (2) of said gas into contact with a recycled liquid phase comprising both water and a solvent generally consisting of a non hydrocarbon organic compound, normally a liquid, other than water, at least partially miscible with water and distillable at a temperature which is lower than the distillation temperature of water, to obtain an aqueous liquid phase which is depleted in solvent when compared to said recycled liquid phase, also a gas phase which is charged with solvent;

c) separating the aqueous phase which is depleted in solvent and the gas phase which is charged with solvent;

d) bringing said aqueous phase which is depleted in solvent into contact with stream (1) of said gas to be treated, which is free of solvent, in a contact zone, to extract the residual solvent from the depleted aqueous phase by the gas, and obtaining a gas phase which is rich in solvent and a regenerated aqueous liquid phase from this step;

e) mixing the solvent-rich gas phase from step (d) either with the gas phase charged with solvent from step (b) or with the stream (2) which is free of solvent from step (a);

f) cooling said gas phase from the mixing step so as to partially condense it into an aqueous phase and a hydrocarbon phase, both containing solvent, and to produce the treated gas, free of at least part of the water and the higher hydrocarbons it contained;

g) separating the aqueous phase and the hydrocarbon phase from step (f) by decanting; and h) recycling the aqueous phase which is rich in solvent to step (b) of the process.

2. A process according to claim 1, characterized in that in step (a), the fraction of gas present in stream (2) is higher than that present in stream (1).

3. A process according to claim 1 or claim 2, characterized in that the gas phase which is rich in solvent from step (d) is mixed with the gas phase which is rich in solvent from step (b) of the process.

4. A process according to claim 1, characterized in that at the end of contact step (c), all of the gas to be treated is brought into contact with the recycled aqueous phase which is rich in solvent during step (b).

5. A process according to claim 1, characterized in that at the end of contact steps (b) and (d), solvent is added to the gas phase to prevent hydrate formation problems linked to the cooling step (f) and to compensate for solvent losses in the treated gas.

6. A process according to claim 5, characterized in that the liquid hydrocarbon phase from step (g) undergoes a washing step to recover the solvent.

7. A process according to claim 6, characterized in that the liquid hydrocarbon is washed with the regenerated aqueous phase from step (d) for which a purge stream is established so as to maintain the quantities of solvent and water present in the total circuit substantially constant.

8. A process according to claim 1, characterized in that the solvent is ethanol, propanol, methylpropylether, ethylpropylether, dipropylether, methyltertiobutylether, dimethoxy-methane, dimethoxyethane or methoxyethanol.

9. A process according to claim 8, characterized in that the solvent is methanol.

10. A process according to claim 1, characterized in that the aqueous phase which is rich in solvent recycled to step (b) contains 50% to 95% by weight of solvent.

11. A process according to claim 1, characterized in that the temperature of the gas phase from step (f) is in the range −15° C. to −80° C. the gas obtained from step (f) being freed of the major portion of the propane it contained at the process inlet.

12. A process according to claim 1, characterized in that the fraction of gas crossing the contact zone of step (d) represents 25% to 95% of the gas to be treated.

13. A process according to claim 1, characterized in that the fraction of gas crossing the contact zone of step (d) represents 30% to 50% of the gas to be treated.

14. A process according to claim 1, characterized in that the liquid hydrocarbon phase from step (g) undergoes a stabilisation step to eliminate volatile compounds therefrom.

15. A process according to claim 1, characterized in that the liquid hydrocarbon phase from step (g) undergoes a washing step to recover the solvent.

16. A process according to claim 15, characterized in that the liquid hydrocarbon phase is washed with the regenerated aqueous phase from step (d) for which a purge stream is established to as to maintain the quantities of solvent and water present in the total circuit substantially constant.

17. A process according to claim 15, characterized in that the liquid hydrocarbon phase washing step is carried out using mixer settlers.

18. A process according to claim 15, characterized in that the liquid hydrocarbon phase washing step is carried out by contact in a column.

* * * * *